US011270654B2

(12) United States Patent
Wang

(10) Patent No.: US 11,270,654 B2
(45) Date of Patent: Mar. 8, 2022

(54) PIXEL CIRCUIT, DISPLAY PANEL, AND METHOD FOR DRIVING PIXEL CIRCUIT

(71) Applicants: ORDOS YUANSHENG OPTOELECTRONICS CO., LTD., Inner Mongolia (CN); BOE TECHNOLOGY GROUP CO., LTD., Beijing (CN)

(72) Inventor: Zhichong Wang, Beijing (CN)

(73) Assignees: ORDOS YUANSHENG OPTOELECTRONICS CO., LTD., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 23 days.

(21) Appl. No.: 16/643,719

(22) PCT Filed: Jan. 14, 2019

(86) PCT No.: PCT/CN2019/071633
§ 371 (c)(1),
(2) Date: Mar. 2, 2020

(87) PCT Pub. No.: WO2020/146978
PCT Pub. Date: Jul. 23, 2020

(65) Prior Publication Data

US 2021/0225293 A1 Jul. 22, 2021

(51) Int. Cl.
*G09G 3/3291* (2016.01)
*G09G 3/3258* (2016.01)
*G09G 3/3266* (2016.01)

(52) U.S. Cl.
CPC ..... *G09G 3/3291* (2013.01); *G09G 3/3258* (2013.01); *G09G 3/3266* (2013.01); *G09G 2310/061* (2013.01)

(58) Field of Classification Search
CPC .... G09G 3/329; G09G 3/3258; G09G 3/3266; G09G 2310/061
See application file for complete search history.

(56) References Cited

U.S. PATENT DOCUMENTS 9,495,907 B2 11/2016 Han
10,347,180 B2 7/2019 Zhu et al.
(Continued)

FOREIGN PATENT DOCUMENTS

CN 203520830 4/2014
CN 103996379 8/2014
(Continued)

OTHER PUBLICATIONS

Chinese Patent Office Action dated Mar. 3, 2021 corresponding to Chinese Patent Application No. 201980000060.4; 27 pages.

*Primary Examiner* — Kenneth B Lee, Jr.
(74) *Attorney, Agent, or Firm* — Leason Ellis LLP

(57) ABSTRACT

A pixel circuit, a display panel, and a method for driving a pixel circuit are disclosed. The pixel circuit includes a driving circuit, a data writing circuit, and a first light-emitting control circuit. The driving circuit is configured to control a driving current for driving a light-emitting component to emit light, the data writing circuit is configured to write a data signal into the driving circuit in response to a scanning signal, the first light-emitting control circuit is configured to apply a first voltage of a first voltage terminal to the driving circuit in response to a first light-emitting control signal, and the first light-emitting control signal and the scanning signal are provided by a same gate driving circuit.

20 Claims, 9 Drawing Sheets

(56) References Cited

U.S. PATENT DOCUMENTS

| | | | | |
|---|---|---|---|---|
| 2015/0364084 | A1 | 12/2015 | Gu et al. | |
| 2019/0005889 | A1 | 1/2019 | Kwon et al. | |
| 2021/0065624 | A1* | 3/2021 | Li | G09G 3/3291 |

FOREIGN PATENT DOCUMENTS

| | | |
|---|---|---|
| CN | 104064145 | 9/2014 |
| CN | 106328055 | 1/2017 |
| CN | 106782330 | 5/2017 |
| WO | 2018175175 | 9/2018 |

* cited by examiner

PIXEL CIRCUIT, DISPLAY PANEL, AND METHOD FOR DRIVING PIXEL CIRCUIT

CROSS-REFERENCE TO RELATED PATENT APPLICATIONS

This application is a U.S. National Stage Application under 35 U.S.C. § 371 of International Patent Application No. PCT/CN2019/071633, filed Jan. 14, 2019, which is incorporated by reference in its entirety.

TECHNICAL FIELD

Embodiments of the present disclosure relate to a pixel circuit, a display panel, and a method for driving a pixel circuit.

BACKGROUND

Compared with traditional liquid crystal panels, organic light-emitting diode (OLED) display panels have advantages such as a faster response speed, a higher contrast, a wider viewing angle, a lower power consumption, and so on, and have been increasingly used for high-performance display.

The pixel circuit in the OLED display panel generally works in a matrix driving manner, and the matrix driving manner is divided into an active matrix (AM) driving and a passive matrix (PM) driving according to whether a switching component is provided in each pixel unit. Although the PMOLED has a simple process and low costs, it cannot satisfy requirements of high-resolution large-scale display because of disadvantages such as cross-talk, high power consumption, short service life, and so on. In contrast, there is a set of thin film transistors and storage capacitors integrated in the pixel circuit of each pixel unit in the AMOLED, and the current flowing through the OLED is controlled by driving and controlling the thin film transistors and storage capacitors, thereby allowing the OLED to emit light as needed. Compared with the PMOLED, the AMOLED requires a smaller driving current, and has a lower power consumption and a longer service life, which can satisfy requirements of large-scale display with high resolution and multiple gray levels. Meanwhile, the AMOLED has obvious advantages in terms of viewing angle, color reproduction, power consumption, response time, etc., and can be applied in the display device with a large amount of information and a high resolution.

SUMMARY

At least one embodiment of the present disclosure provides a pixel circuit, and the pixel circuit includes: a driving circuit, a data writing circuit, and a first light-emitting control circuit; the driving circuit includes a control terminal, a first terminal, and a second terminal, and the driving circuit is configured to control a driving current flowing through the first terminal and the second terminal for driving a light-emitting component to emit light; the data writing circuit is connected to the first terminal of the driving circuit, and is configured to write a data signal into the driving circuit in response to a scanning signal; and the first light-emitting control circuit is connected to the first terminal of the driving circuit and a first voltage terminal, and is configured to apply a first voltage of the first voltage terminal to the first terminal of the driving circuit in response to a first light-emitting control signal, and the first light-emitting control signal and the scanning signal are provided by a same gate driving circuit.

For example, in the pixel circuit provided by at least one embodiment of the present disclosure, the first light-emitting control signal and the scanning signal have inverting phases.

For example, the pixel circuit provided by at least one embodiment of the present disclosure further includes a second light-emitting control circuit; and the second light-emitting control circuit is connected to the second terminal of the driving circuit and the light-emitting component, and is configured to apply the driving current to the light-emitting component in response to a second light-emitting control signal.

For example, in the pixel circuit provided by at least one embodiment of the present disclosure, the second light-emitting control signal, the first light-emitting control signal, and the scanning signal are provided by the same gate driving circuit, and the second light-emitting control signal and the first light-emitting control signal have an identical waveform but have different phases.

For example, the pixel circuit provided by at least one embodiment of the present disclosure further includes a compensation circuit; and the compensation circuit is connected to the control terminal of the driving circuit, the second terminal of the driving circuit, and the first voltage terminal, and is configured to store the data signal written by the data writing circuit, cooperate with the data writing circuit to write the data signal into the control terminal of the driving circuit in response to the scanning signal, and perform compensation on the driving circuit.

For example, the pixel circuit provided by at least one embodiment of the present disclosure further includes a reset circuit; and the reset circuit is connected to a reset voltage terminal, and is configured to apply a reset voltage of the reset voltage terminal to the light-emitting component in response to the scanning signal and apply the reset voltage to the control terminal of the driving circuit through the compensation circuit.

For example, in the pixel circuit provided by at least one embodiment of the present disclosure, the driving circuit includes a first transistor, a gate electrode of the first transistor serves as the control terminal of the driving circuit, a first electrode of the first transistor serves as the first terminal of the driving circuit, and a second electrode of the first transistor serves as the second terminal of the driving circuit.

For example, in the pixel circuit provided by at least one embodiment of the present disclosure, the data writing circuit includes a second transistor, a gate electrode of the second transistor is connected to a scanning line to receive the scanning signal, a first electrode of the second transistor is connected to a data line to receive the data signal, and a second electrode of the second transistor is connected to the first terminal of the driving circuit.

For example, in the pixel circuit provided by at least one embodiment of the present disclosure, the reset circuit includes a third transistor, a gate electrode of the third transistor is connected to a scanning line to receive the scanning signal, a first electrode of the third transistor is connected to the light-emitting component, and a second electrode of the third transistor is connected to the reset voltage terminal to receive the reset voltage.

For example, in the pixel circuit provided by at least one embodiment of the present disclosure, the compensation circuit includes a fourth transistor and a capacitor, a gate electrode of the fourth transistor is connected to a scanning line to receive the scanning signal, a first electrode of the fourth transistor is connected to the second terminal of the driving circuit, and a second electrode of the fourth transistor is connected to the control terminal of the driving circuit; and a first electrode of the capacitor is connected to the control terminal of the driving circuit, and a second electrode of the capacitor is connected to the first voltage terminal.

For example, in the pixel circuit provided by at least one embodiment of the present disclosure, the first light-emitting control circuit includes a fifth transistor, a gate electrode of the fifth transistor is connected to a first light-emitting control line to receive the first light-emitting control signal, a first electrode of the fifth transistor is connected to the first voltage terminal to receive the first voltage, and a second electrode of the fifth transistor is connected to the first terminal of the driving circuit.

For example, in the pixel circuit provided by at least one embodiment of the present disclosure, the second light-emitting control circuit includes a sixth transistor, a gate electrode of the sixth transistor is connected to a second light-emitting control line to receive the second light-emitting control signal, a first electrode of the sixth transistor is connected to the second terminal of the driving circuit, and a second electrode of the sixth transistor is connected to the light-emitting component.

At least one embodiment of the present disclosure further provides a display panel, and the display panel includes a plurality of pixel units arranged in a plurality of rows and a plurality of columns; and each of the pixel units includes the pixel circuit provided by any one of the embodiments of the present disclosure.

For example, the display panel provided by at least one embodiment of the present disclosure further includes a gate driving circuit and a plurality of signal control units; the gate driving circuit includes a plurality of gate driving signal output terminals, and the plurality of gate driving signal output terminals are in one-to-one correspondence with the plurality of signal control units; each of the gate driving signal output terminals and each of the signal control units correspond to pixel units in one row to provide the scanning signal and the first light-emitting control signal; a signal control unit includes a signal input terminal, a first signal output terminal, and a second signal output terminal, the signal input terminal of the signal control unit is connected to a corresponding gate driving signal output terminal to receive a gate driving signal, and a signal provided by the first signal output terminal of the signal control unit and a signal provided by the second signal output terminal of the signal control unit have inverting phases; a first signal output terminal of an n-th signal control unit provides the scanning signal to the pixel circuit of each pixel unit in an n-th row through a scanning line, and a second signal output terminal of the n-th signal control unit provides the first light-emitting control signal to the pixel circuit of each pixel unit in the n-th row through a first light-emitting control line; and n is an integer greater than 0.

For example, in the display panel provided by at least one embodiment of the present disclosure, in a case where the pixel unit includes a second light-emitting control circuit, a second signal output terminal of an (n+1)-th signal control unit further provides a second light-emitting control signal to the pixel circuit of each pixel unit in the n-th row through a second light-emitting control line.

For example, in the display panel provided by at least one embodiment of the present disclosure, the signal control unit includes an inverting circuit, and the inverting circuit is configured to invert a phase of the gate driving signal and output a signal which is obtained by inverting the phase of the gate driving signal through the second signal output terminal of the signal control unit.

At least one embodiment of the present disclosure further provides a method for driving the pixel circuit provided by any one of the embodiments of the present disclosure, and the method includes: a data writing phase and a light-emitting phase; in the data writing phase, the scanning signal is input to turn on the data writing circuit, so as to allow the data writing circuit to write the data signal into the driving circuit, and the first light-emitting control signal provided by the same gate driving circuit with the scanning signal is input to turn off the first light-emitting control circuit; and in the light-emitting phase, the first light-emitting control signal is input to turn on the first light-emitting control circuit and the driving circuit, the first light-emitting control circuit applies the first voltage to the first terminal of the driving circuit, and the driving current flows through the first terminal of the driving circuit and the second terminal of the driving circuit and further flows through the light-emitting component to drive the light-emitting component to emit light.

For example, in the method for driving the pixel circuit provided by at least one embodiment of the present disclosure, in a case where the pixel circuit includes a second light-emitting control circuit, in the light-emitting phase, a second light-emitting control signal is input to turn on the second light-emitting control circuit.

For example, in the method for driving the pixel circuit provided by at least one embodiment of the present disclosure, in a case where the pixel circuit includes a compensation circuit, in the data writing phase, the scanning signal is input to turn on the data writing circuit, the driving circuit, and the compensation circuit, and the compensation circuit stores the data signal and performs compensation on the driving circuit.

For example, in the method for driving the pixel circuit provided by at least one embodiment of the present disclosure, in a case where the pixel circuit includes a reset circuit, the method for driving the pixel circuit further includes an initialization phase; and in the initialization phase, the scanning signal is input to turn on the reset circuit and the compensation circuit, and a reset voltage is applied to the control terminal of the driving circuit and the light-emitting component.

BRIEF DESCRIPTION OF THE DRAWINGS

In order to clearly illustrate the technical solution of the embodiments of the present disclosure, the drawings of the embodiments will be briefly described in the following. It is obvious that the described drawings in the following are only related to some embodiments of the present disclosure and thus are not limitative of the present disclosure.

DETAILED DESCRIPTION

Figure 1:
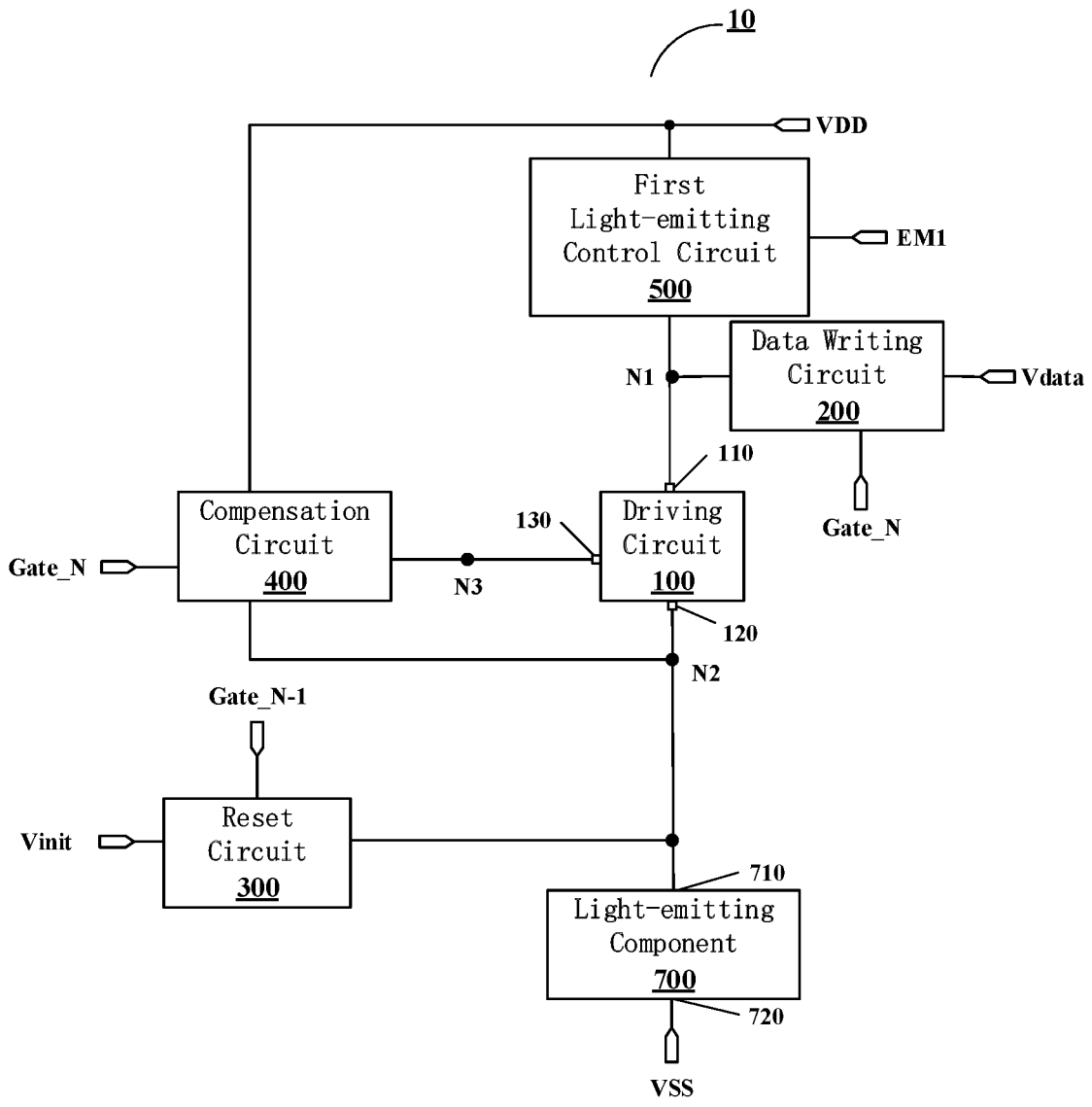
FIG. 1 is a schematic block diagram of a pixel circuit provided by some embodiments of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", "coupled", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

An OLED display device generally includes a plurality of pixel units in an array arrangement, and each pixel unit can implement a basic function of driving the OLED to emit light through a pixel circuit. The basic pixel circuit used in an AMOLED display device is usually a pixel circuit of 2T1C, that is, two thin film transistors (TFTs) and a storage capacitor Cs are used to implement the basic function of driving the OLED to emit light. The pixel circuit used in the AMOLED display device may also be a pixel circuit of other structures, such as a pixel circuit of 4T1C, 4T2C, 6T1C, 8T2C, or the like. However, the driving signals (including the scanning signal and the light-emitting control signal) required for the above pixel circuit usually need to be provided by two or even more than two gate driving circuits, for example, one gate driving circuit outputs the scanning signal and another gate driving circuit outputs the light-emitting control signal. Therefore, a large area of integration space needs to be provided for the gate driving circuits in the frame region of the display panel, so that the frame size of the display panel is limited and the display panel cannot be provided with a narrow frame. In addition, a plurality of gate driving circuits increase the complexity of the display panel and are not conducive to reducing the production cost.

At least one embodiment of the present disclosure provides a pixel circuit, and the pixel circuit includes a driving circuit, a data writing circuit, and a first light-emitting control circuit. The driving circuit includes a control terminal, a first terminal, and a second terminal, and the driving circuit is configured to control a driving current flowing through the first terminal and the second terminal for driving a light-emitting component to emit light; the data writing circuit is connected to the first terminal of the driving circuit and is configured to write a data signal into the driving circuit in response to a scanning signal; and the first light-emitting control circuit is connected to the first terminal of the driving circuit and a first voltage terminal, and is configured to apply a first voltage of the first voltage terminal to the first terminal of the driving circuit in response to a first light-emitting control signal, and the first light-emitting control signal and the scanning signal are provided by a same gate driving circuit.

The driving signals (such as the first light-emitting control signal and the scanning signal) required for the pixel circuit of the embodiments can be output by the same gate driving circuit, thereby reducing the layout space required for the gate driving circuit, allowing the frame size of the display panel to be greatly reduced, facilitating implementing a narrow frame, and reducing the production cost.

At least one embodiment of the present disclosure further provides a method for driving the above pixel circuit, and a display panel including the above pixel circuit.

Hereinafter, some embodiments of the present disclosure are described in detail with reference to the accompanying drawings. It should be noted that the same reference numerals in different drawings are used to refer to the same described components.

FIG. 1 is a schematic block diagram of a pixel circuit 10 provided by some embodiments of the present disclosure. As illustrated in FIG. 1, the pixel circuit 10 includes a driving circuit 100, a data writing circuit 200, a first light-emitting control circuit 500, and a light-emitting component 700.

In some embodiments of the present disclosure, the pixel circuit 10 may further include a reset circuit 300 and a compensation circuit 400.

For example, the driving circuit 100 includes a first terminal 110, a second terminal 120, and a control terminal 130, and the driving circuit 100 is configured to control a driving current flowing through the first terminal 110 and the second terminal 120 for driving the light-emitting component 700 to emit light. The first terminal 110 of the driving circuit 100 is connected to a first node N1, the second terminal 120 of the driving circuit 100 is connected to a second node N2, and the control terminal 130 of the driving circuit 100 is connected to a third node N3. For example, in a light-emitting phase, the driving circuit 100 applies the driving current to the light-emitting component 700 to drive the light-emitting component 700 to emit light, and allows the light-emitting component 700 to emit light according to a required "gray level". For example, the light-emitting component 700 may use an OLED or a quantum dot light-emitting diode (QLED), and is configured to be connected to the second node N2 and a second voltage terminal VSS (for example, a low-level voltage terminal or a grounded voltage terminal), and the embodiments of the present disclosure include this case but are not limited thereto.

For example, the data writing circuit 200 is connected to the first terminal 110 of the driving circuit 100, and is configured to write a data signal Vdata into the first terminal 110 of the driving circuit 100 in response to a scanning signal Gate_N. For example, the data writing circuit 200 is connected to the first node N1, a data line providing the data signal Vdata, and a scanning line providing the scanning signal Gate_N, respectively. For example, the scanning signal Gate_N is applied to the data writing circuit 200 to control whether the data writing circuit 200 is turned on.

For example, in a data writing phase, the data writing circuit 200 may be turned on in response to the scanning signal Gate_N, so that the data signal Vdata can be written into the first terminal 110 of the driving circuit 100 and stored in the compensation circuit 400, so as to generate the driving current for driving the light-emitting component 700 to emit light according to the data signal Vdata, for example, in the light-emitting phase.

For example, the reset circuit 300 is connected to a reset voltage terminal Vinit, and is configured to apply a reset voltage Vinit of the reset voltage terminal to the light-emitting component 700 and the driving circuit 100 in response to a scanning signal Gate_N−1 (for scanning a row previous to the row applied by the scanning signal Gate_N). For example, as illustrated in FIG. 1, the reset circuit 300 is connected to the second node N2, the reset voltage terminal providing the reset voltage Vinit, and a scanning line providing the scanning signal Gate_N−1, respectively.

For example, in an initialization phase, the reset circuit 300 may be turned on in response to the scanning signal Gate_N−1, so that the reset voltage Vinit can be applied to the second node N2 and a first terminal 710 of the light-emitting component 700, and the reset voltage Vinit can be further applied to the third node N3 through the compensation circuit 400. That is, the reset voltage Vinit is applied to the control terminal 130 of the driving circuit 100, so that the driving circuit 100, the compensation circuit 400, and the light-emitting component 700 can be reset to eliminate the influence of the previous light-emitting phase.

For example, the compensation circuit 400 is connected to the control terminal 130 of the driving circuit 100, the second terminal 120 of the driving circuit 100, and a first voltage terminal VDD, and is configured to store the data signal Vdata written by the data writing circuit 200, perform compensation on the driving circuit 100 in response to the scanning signal Gate_N, and cooperate with the reset circuit 300 to apply the reset voltage Vinit to the control terminal 130 of the driving circuit 100. For example, the compensation circuit 400 is connected to the second node N2, the third node N3, the first voltage terminal VDD, and the scanning line providing the scanning signal Gate_N, respectively. For example, the scanning signal Gate_N is applied to the compensation circuit 400 to control whether the compensation circuit 400 is turned on.

For example, in the case where the compensation circuit 400 includes a capacitor, for example, in the data writing phase, the compensation circuit 400 may be turned on in response to the scanning signal Gate_N, so that the data signal Vdata written by the data writing circuit 200 can be stored in the capacitor. For example, in the data writing phase, the compensation circuit 400 can electrically connect the control terminal 130 of the driving circuit 100 to the second terminal 120 of the driving circuit 100, so that the information of the threshold voltage of the driving circuit 100 is also accordingly stored in the capacitor. Therefore, in the light-emitting phase, for example, the stored data signal Vdata and the stored threshold voltage of the driving circuit 100 can be used to control the driving circuit 100, so that the output of the driving circuit 100 is compensated.

For example, the first light-emitting control circuit 500 is connected to the first terminal 110 of the driving circuit 100 and the first voltage terminal VDD, and is configured to apply a first voltage of the first voltage terminal VDD to the first terminal 110 of the driving circuit 100 in response to a first light-emitting control signal EM1. For example, the first light-emitting control circuit 500 is connected to the first voltage terminal VDD, the first node N1, and a first light-emitting control line providing the first light-emitting control signal EM1, respectively. For example, the first voltage provided by the first voltage terminal VDD may be a driving voltage, such as a high voltage (e.g., higher than a second voltage provided by the second voltage terminal VSS).

For example, in the light-emitting phase, the first light-emitting control circuit 500 may be turned on in response to the first light-emitting control signal EM1, so that the first voltage of the first voltage terminal VDD can be applied to the first terminal 110 of the driving circuit 100, and the driving circuit 100 can provide the driving current to the light-emitting component 700 where the driving circuit 100 is turned on, so as to drive the light-emitting component 700 to emit light.

For example, the light-emitting component 700 includes the first terminal 710 and a second terminal 720. The first terminal 710 of the light-emitting component 700 is configured to receive the driving current from the second terminal 120 of the driving circuit 100, and the second terminal 720 of the light-emitting component 700 is configured to be connected to the second voltage terminal VSS. For example, the first terminal 710 of the light-emitting component 700 is connected to the second node N2, and the embodiments of the present disclosure include this case but are not limited thereto.

For example, in the embodiments of the present disclosure, the first light-emitting control signal EM1 and the scanning signal Gate_N are provided by a same gate driving circuit, so that the driving signals required for the pixel circuit 10 can be output from the same gate driving circuit, thereby reducing the layout space required for the gate driving circuit of the display panel including the pixel circuit 10, allowing the frame size of the display panel to be greatly reduced, facilitating reducing the complexity of the display panel, and reducing the production cost.

For example, in the embodiments of the present disclosure, the gate driving circuit is configured to output at least one set of scanning signals based on the timing signals. Among the set of scanning signals, the same predetermined time interval is between adjacent scanning signals, and the set of scanning signals corresponds to a scanning operation of one frame of the display device. For example, the gate driving circuit can be of various types. For example, the gate driving circuit may be a gate driving chip and includes a plurality of scanning signal output terminals. For example, the gate driving circuit is electrically connected to a plurality of gate lines and a plurality of light-emitting control lines of the array substrate of the display device in a bonding manner, respectively, thereby providing scanning signals and light-emitting control signals, respectively. Alternatively, the gate driving circuit may be a gate driver on array (GOA), and is directly prepared on the array substrate. For example, the gate driving circuit includes a plurality of shift registers which are sequentially cascaded, and each of the shift registers includes a scanning signal output terminal, and the scanning signal output terminal is directly or indirectly in electrical connection to a plurality of gate lines and a plurality of light-emitting control lines of the army substrate of the display device through connection wires, respectively, thereby providing scanning signals and light-emitting control signals, respectively. The embodiments of the present disclosure do not limit the specific structure of the shift register.

For example, the first light-emitting control signal EM1 and the scanning signal Gate_N may have the same period, and for example, may have inverting phases, and the embodiments of the present disclosure include this case but are not limited thereto.

Figure 2:
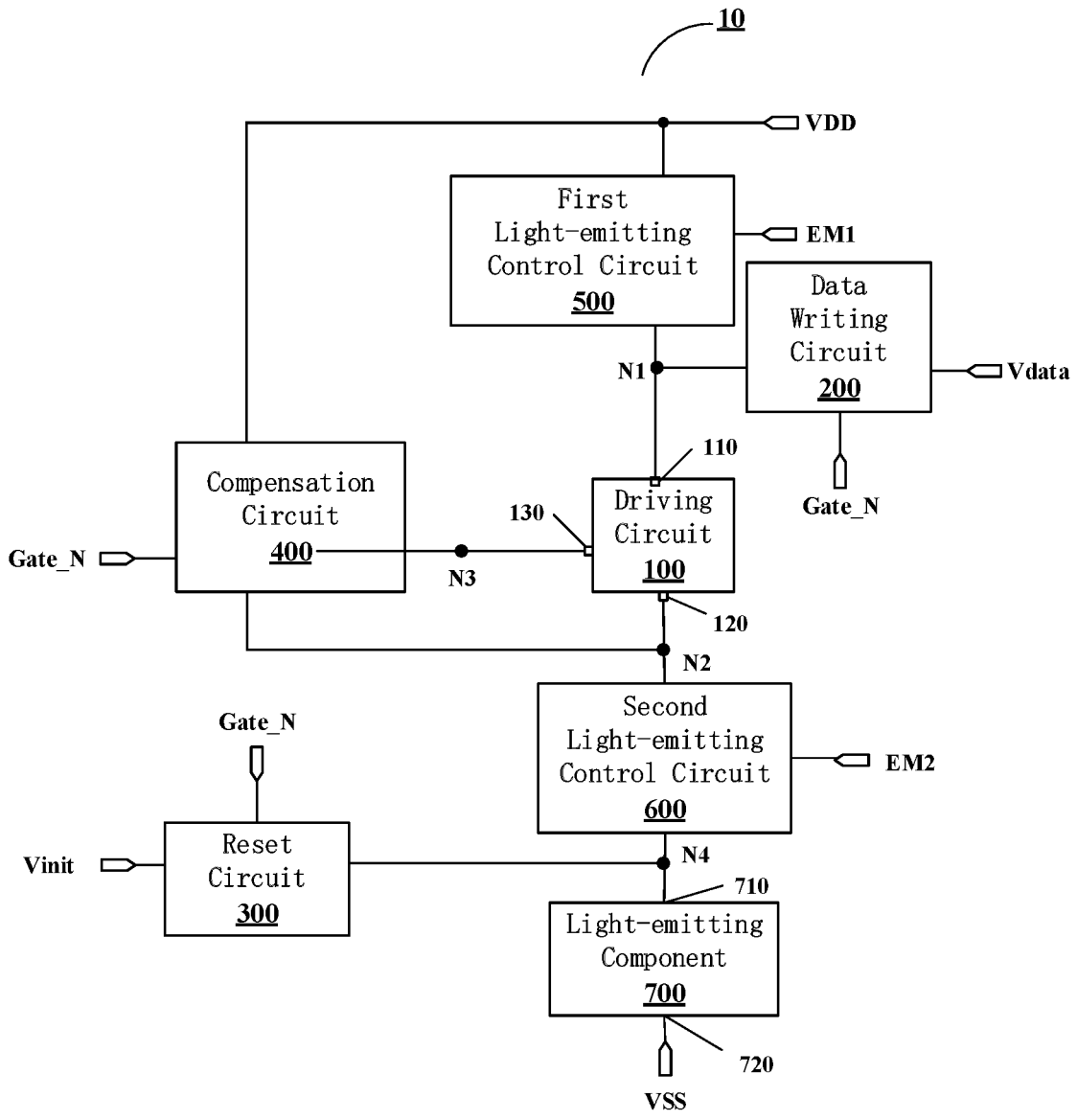
FIG. 2 is a schematic block diagram of another pixel circuit provided by some embodiments of the present disclosure.

FIG. 2 is a schematic block diagram of another pixel circuit 10 provided by some embodiments of the present disclosure. As illustrated in FIG. 2, in addition to the driving circuit 100, the data writing circuit 200, the reset circuit 300, the compensation circuit 400, the first light-emitting control circuit 500 and the light-emitting component 700, the pixel circuit 10 may further include a second light-emitting control circuit 600.

For example, the reset circuit 300 is connected to the reset voltage terminal Vinit, and is configured to apply the reset voltage Vinit of the reset voltage terminal to the light-emitting component 700 and the driving circuit 100 in response to the scanning signal Gate_N. For example, as illustrated in FIG. 2, the reset circuit 300 is connected to the second node N2, the reset voltage terminal providing the reset voltage Vinit, and the scanning line providing the scanning signal Gate_N, respectively. It should be noted that the reset circuit 300 illustrated in FIG. 2 may also be connected to the scanning line providing the scanning signal Gate_N−1, and is turned on in response to the scanning signal Gate_N−1 (that is, similar to the connection of the reset circuit 300 illustrated in FIG. 1). For example, the scanning signal Gate_N−1 and the scanning signal Gate_N are scanning signals respectively provided to the pixel circuits of two adjacent rows of pixel units in an array arrangement, and the embodiments of the present disclosure are not limited in this aspect.

For example, the second light-emitting control circuit 600 is connected to the second terminal 120 of the driving circuit 100 and the light-emitting component 700, and is configured to apply the driving current to the light-emitting component 700 in response to a second light-emitting control signal EM2. For example, the second light-emitting control circuit 600 is connected to the second node N2, a fourth node N4, and a second light-emitting control line providing the second light-emitting control signal EM2, respectively.

For example, as illustrated in FIG. 2, in the case where the pixel circuit 10 includes the second light-emitting control circuit 600, the first terminal 710 of the light-emitting component 700 is connected to the fourth node N4 and is further connected to the second node N2 through the second light-emitting control circuit 600, and the embodiments of the present disclosure include this case but are not limited thereto.

For example, as illustrated in FIG. 2, in the case where the pixel circuit 10 includes the second light-emitting control circuit 600, the reset circuit 300 is connected to the fourth node N4, the reset voltage terminal Vinit, and the scanning line providing the scanning signal Gate_N, respectively, and is further connected to the second node N2 through the second light-emitting control circuit 600, and the embodiments of the present disclosure include this case but are not limited thereto.

For example, in the light-emitting phase, the second light-emitting control circuit 600 is turned on in response to the second light-emitting control signal EM2, so that the driving circuit 100 can apply the driving current to the light-emitting component 700 through the second light-emitting control circuit 600, so as to allow the light-emitting component 700 to emit light. In the non-light-emitting phase, such as the data writing phase, the second light-emitting control circuit 600 may be turned off in response to the second light-emitting control signal EM2, thereby preventing a current from flowing through the light-emitting component 700 to drive the light-emitting component 700 to emit light, so that the corresponding contrast of the display panel is improved. For another example, in the initialization phase, the second light-emitting control circuit 600 may also be turned on in response to the second light-emitting control signal EM2, so that the second light-emitting control circuit 600 can cooperate with the reset circuit 300 to perform a reset operation on the driving circuit 100.

In some embodiments of the present disclosure, the second light-emitting control signal EM2 is different from the first light-emitting control signal EM1. For example, in some embodiments of the present disclosure, the second light-emitting control signal EM2, the first light-emitting control signal EM, and the scanning signal Gate_N are provided by the same gate driving circuit, and the second light-emitting control signal EM2 and the first light-emitting control signal EM1 have the same waveform but have different phases. For example, in the initialization phase, only the second light-emitting control signal EM2 is configured to be a turn-on signal (that is, at an effective level), so that the second light-emitting control circuit 600 cooperates with the reset circuit 300 to perform the reset operation on the driving circuit 100. For example, in the light-emitting phase, both the first light-emitting control signal EM1 and the second light-emitting control signal EM2 are configured to be turn-on signals, thereby allowing the light-emitting component 700 to emit light.

For example, in a display panel, in the case where the pixel circuits 10 of a plurality of pixel units are arranged in an array, for pixel units in one row, the first light-emitting control signal EM1 can control the first light-emitting control circuits 500 in the pixel circuits 10 of the pixel units of the row. Further, the first light-emitting control signal EM1 can also be provided to the pixel circuits 10 of the pixel units in the previous row as the second light-emitting control signal EM2, so as to control the second light-emitting control circuits 600 in the pixel circuits 10 of the pixel units of the previous row. Similarly, the second light-emitting control signal EM2 can control the second light-emitting control circuits 600 in the pixel circuits 10 of the pixel units of the row. Further, the second light-emitting control signal EM2 can also be provided to the pixel circuits 10 of the pixel units in the next row as the first light-emitting control signal EM1, so as to control the first light-emitting control circuits 500 in the pixel circuits 10 of the pixel units of the next row. The manner of allowing the light-emitting control signal to be used for both the previous row and the present row or for both the present row and the next row can further simplify the layout space of the gate driving circuit of the display panel, and greatly reduce the frame size of the display panel.

For example, in some embodiments of the present disclosure, the second light-emitting control signal EM2 and the first light-emitting control signal EM1 may also be connected to different signal output terminals of the gate driving circuit. For example, the first light-emitting control signal EM1 and the second light-emitting control signal EM2 may have different waveforms, and the falling edge of the second light-emitting control signal EM2 may coincide with the falling edge of the first light-emitting control signal EM1, so that the pixel circuit 10 is directly changed from the data writing phase to the light-emitting phase.

It should be noted that in some embodiments of the present disclosure, in the case where the driving circuit 100 is implemented as a driving transistor, for example, a gate electrode of the driving transistor may serve as the control terminal 130 of the driving circuit 100 and be connected to the third node N3, a first electrode (e.g., a source electrode) of the driving transistor may serve as the first terminal 110 of the driving circuit 100 and be connected to the first node N1, and a second electrode (e.g., a drain electrode) of the driving transistor may serve as the second terminal 120 of the driving circuit 100 and be connected to the second node N2.

It should be noted that, in the embodiments of the present disclosure, the first voltage terminal VDD keeps providing a DC high-level signal, and the DC high level is referred to as the first voltage. For example, the second voltage terminal VSS keeps providing a DC low-level signal, and the DC low level is referred to as the second voltage and is lower than the first voltage. The following embodiments are the same and details are not described again.

It should be noted that, in the description of the embodiments of the present disclosure, the first node N1, the second node N2, the third node N3, and the fourth node N4 do not indicate actual components, but rather indicate the connection points of related circuit connections in the circuit diagram.

It should be noted that in the description of the embodiments of the present disclosure, the numeral Vinit can represent both the reset voltage terminal and the reset voltage, the numeral VDD can represent both the first voltage terminal and the first voltage, and the numeral VSS can represent both the second voltage terminal and the second voltage. The following embodiments are the same and details are not described again.

In the following, the structure of the pixel circuit 10 illustrated in FIG. 2 is taken as an example to describe a specific implementation manner of the pixel circuit 10 and a method for driving the pixel circuit 10.

Figure 3:
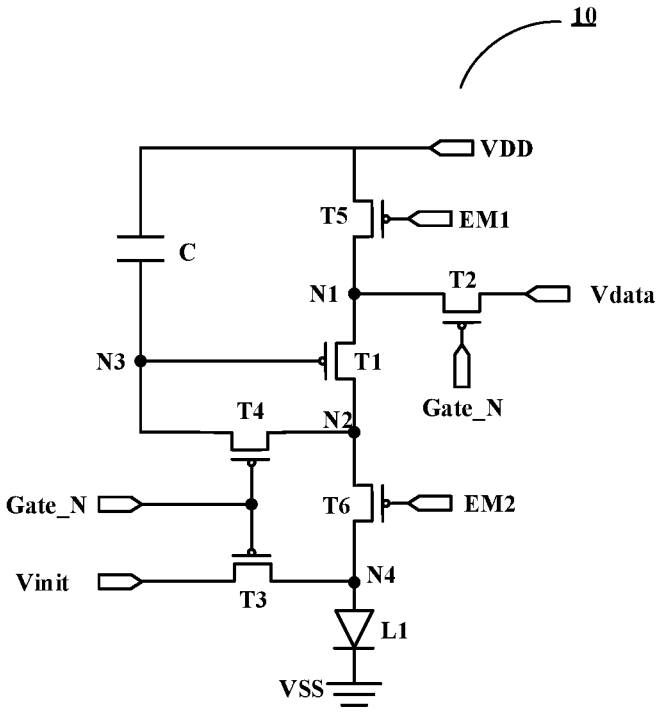
FIG. 3 is a circuit diagram of a specific example of the pixel circuit illustrated in FIG. 2.

FIG. 3 is a circuit diagram of a specific example of the pixel circuit 10 illustrated in FIG. 2. As illustrated in FIG. 3, the pixel circuit 10 includes first to sixth transistors T1, T2, T3, T4, T5, and T6, and includes a capacitor C and a light-emitting component L. For example, the first transistor T1 is used as a driving transistor, and the other second to sixth transistors are used as switching transistors. For example, the light-emitting component L1 may be various types of OLEDs, such as top emission, bottom emission, double-sided emission, etc., and may emit red light, green light, blue light, or white light, and the embodiments of the present disclosure are not limited in this aspect.

For example, all the first to sixth transistors T1, T2, T3, T4, T5, and T6 can be N-type transistors or P-type transistors; or, some transistors can be N-type transistors and other transistors can be P-type transistors. Hereinafter, all the first to sixth transistors T1, T2, T3, T4, T5, and T6 are P-type transistors and are turned on in response to a low-level signal, which is taken as an example for description.

For example, as illustrated in FIG. 3, the driving circuit 100 may be implemented as the first transistor T. A gate electrode of the first transistor T1 serves as the control terminal 130 of the driving circuit 100 and is connected to the third node N3; a first electrode of the first transistor T1 serves as the first terminal 110 of the driving circuit 100 and is connected to the first node N1; and a second electrode of the first transistor T1 serves as the second terminal 120 of the driving circuit 100 and is connected to the second node N2. It should be noted that the embodiments of the present disclosure are not limited thereto, and the driving circuit 100 may also be a circuit composed of other components.

For example, the data writing circuit 200 may be implemented as the second transistor T2. A gate electrode of the second transistor T2 is connected to the scanning line to receive the scanning signal Gate_N, a first electrode of the second transistor T2 is connected to the data line to receive the data signal Vdata, and a second electrode of the second transistor T2 is connected to the first terminal 110 (the first node N1) of the driving circuit 100. It should be noted that the embodiments of the present disclosure are not limited thereto, and the data writing circuit 200 may also be a circuit composed of other components.

For example, the reset circuit 300 may be implemented as the third transistor T3. A gate electrode of the third transistor T3 is connected to the scanning line to receive the scanning signal Gate_N, a first electrode of the third transistor T3 is connected to the first terminal 710 (the fourth node N4) of the light-emitting component 700, and a second electrode of the third transistor T3 is connected to the reset voltage terminal Vinit to receive the reset voltage Vinit. It should be noted that the embodiments of the present disclosure are not limited thereto, and the reset circuit 300 may also be a circuit composed of other components.

For example, the compensation circuit 400 may be implemented as the fourth transistor T4 and the capacitor C. A gate electrode of the fourth transistor T4 is connected to the scanning line to receive the scanning signal Gate_N, a first electrode of the fourth transistor T4 is connected to the second terminal 120 (the second node N2) of the driving circuit 100, and a second electrode of the fourth transistor T4 is connected to the control terminal 130 (the third node N3) of the driving circuit 100. A first electrode of the capacitor C is connected to the control terminal 130 of the driving circuit 100, and a second electrode of the capacitor C is connected to the first voltage terminal VDD. It should be noted that the embodiments of the present disclosure are not limited thereto, and the compensation circuit 400 may also be a circuit composed of other components.

For example, the first light-emitting control circuit 500 may be implemented as the fifth transistor T5. A gate electrode of the fifth transistor T5 is connected to the first light-emitting control line to receive the first light-emitting control signal EM, a first electrode of the fifth transistor T5 is connected to the first voltage terminal VDD to receive the first voltage, and a second electrode of the fifth transistor T5 is connected to the first terminal 110 (the first node N1) of the driving circuit 100. It should be noted that the embodiments of the present disclosure are not limited thereto, and the first light-emitting control circuit 500 may also be a circuit composed of other components.

For example, the second light-emitting control circuit 600 may be implemented as the sixth transistor T6. A gate electrode of the sixth transistor T6 is connected to the second light-emitting control line to receive the second light-emitting control signal EM2, a first electrode of the sixth transistor T6 is connected to the second terminal 120 (the second node N2) of the driving circuit 100, and a second electrode of the sixth transistor T6 is connected to the light-emitting component 700 (the fourth node N4). It should be noted that the embodiments of the present disclosure are not limited thereto, and the second light-emitting control circuit 600 may also be a circuit composed of other components.

For example, the first terminal 710 (here, the anode) of the light-emitting component L1 is connected to the fourth node N4 and is configured to receive the driving current from the second terminal 120 of the driving circuit 100 through the second light-emitting control circuit 600, and the second terminal 720 (here, the cathode) of the light-emitting component L1 is connected to the second voltage terminal VSS to receive the second voltage. For example, the second voltage terminal VSS may be grounded, that is, the second voltage may be 0V.

In the following, the working principle of the pixel circuit 10 illustrated in FIG. 3 is described with reference to the signal timing diagram illustrated in FIG. 4.

Figure 4:
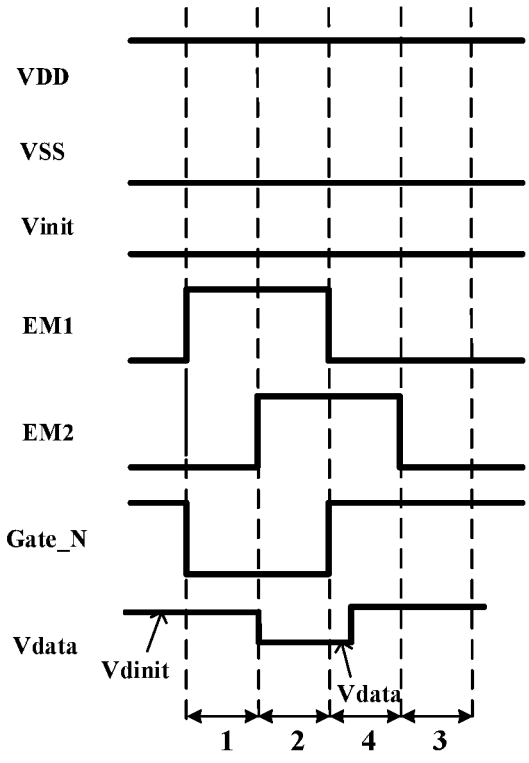
FIG. 4 is a signal timing diagram of a pixel circuit provided by some embodiments of the present disclosure.

As illustrated in FIG. 4, the display process of each frame of the pixel circuit 10 includes three phases, and the three phases are an initialization phase 1, a data writing phase 2, and a light-emitting phase 3. FIG. 4 illustrates the timing waveform of each of the signals in each phase.

Figure 5:
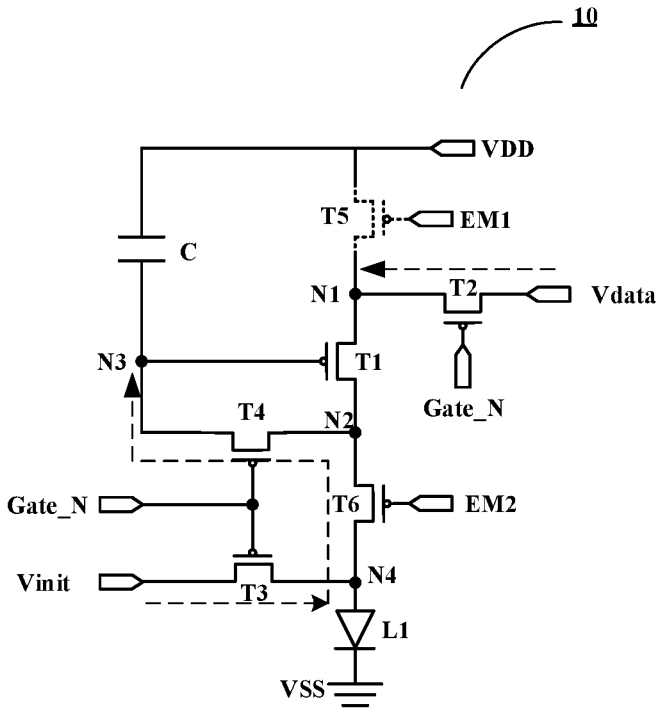
FIG. 5 to FIG. 8 are schematic circuit diagrams of the pixel circuit illustrated in FIG. 3 respectively corresponding to four phases in FIG. 4.
Figure 6:
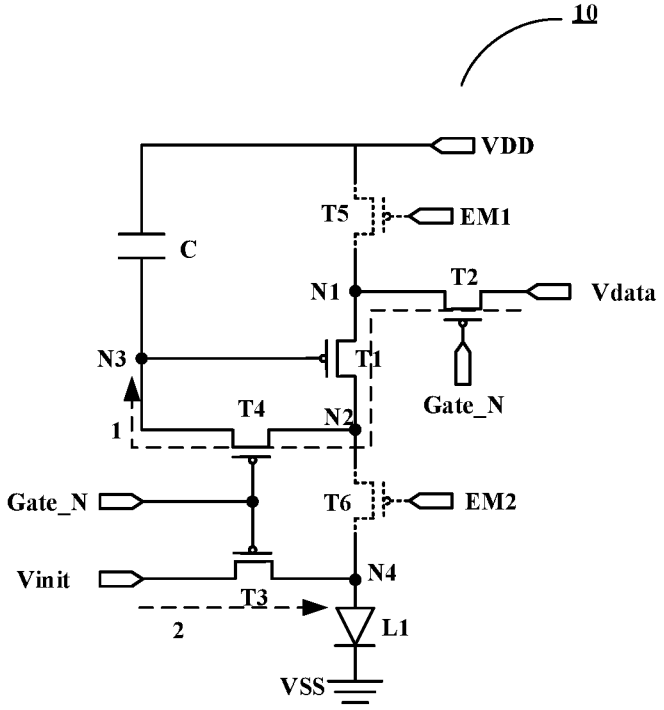
Figure 7:
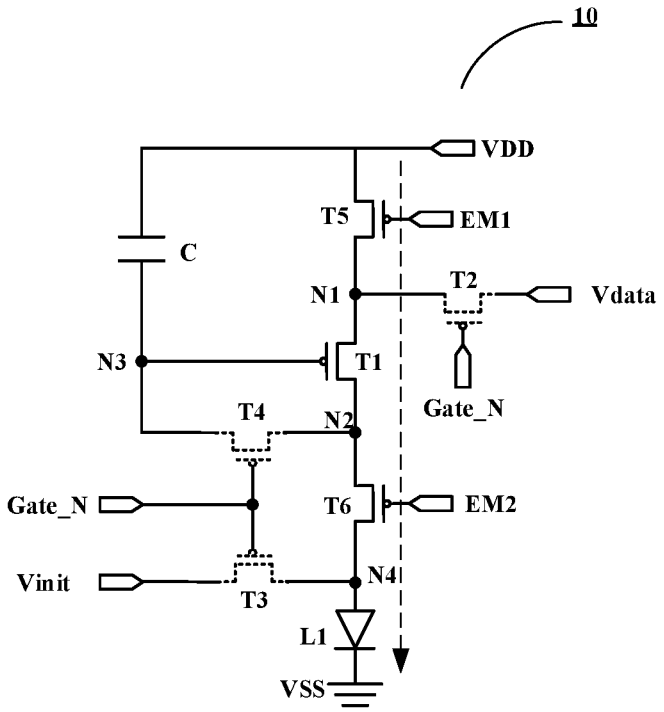

It should be noted that FIG. 5 is a schematic diagram where the pixel circuit 10 illustrated in FIG. 3 is in the initialization phase 1, FIG. 6 is a schematic diagram where the pixel circuit 10 illustrated in FIG. 3 is in the data writing phase 2, and FIG. 7 is a schematic diagram where the pixel circuit 10 illustrated in FIG. 3 is in the light-emitting phase 3. The transistors marked with dashed lines in FIG. 5 to FIG. 7 indicate that the transistors are in a turn-off state in the corresponding phases, and the dashed lines with arrows in FIG. 5 to FIG. 7 indicate the current flowing paths of the pixel circuit 10 in the corresponding phases. For example, according to different applied voltages, the current direction can be the same or opposite to the direction illustrated by the path. All the transistors illustrated in FIG. 5 to FIG. 7 are P-type transistors, which is taken as an example for description, that is, the gate electrode of each P-type transistor is turned on where a low level is provided, and is turned off where a high level is provided. The following embodiments are the same and details are not described again.

In the initialization phase 1, the scanning signal Gate_N and the second light-emitting control signal EM2 are input to turn on the reset circuit 300, the compensation circuit 400, and the second light-emitting control circuit 600, and the reset voltage Vinit is applied to the control terminal 130 of the driving circuit 100, the second terminal 120 of the driving circuit 100, and the first terminal 710 of the light-emitting component 700. Simultaneously, in the initialization phase 1, the scanning signal Gate_N is input to further turn on the data writing circuit 200, so that a data initial voltage Vdinit applied through the data line can be applied to the first terminal 110 of the driving circuit 100 through the data writing circuit 200. Therefore, the value of the voltage of the first terminal 110 of the driving circuit 100 can be refreshed to the data initial voltage Vdinit before the data writing phase of each frame, so that the display image of the present frame is not affected by the data signal of the previous frame, thereby allowing the working effect of the driving circuit 100 in the data writing phase 2 of the present frame to be optimized. For example, as illustrated in FIG. 4, the data initial voltage Vdinit may be a voltage signal higher than the reset voltage Vinit, and may be, for example, the first voltage VDD, and the embodiments are not limited in this aspect. It should be noted that the data line can provide the data initial voltage Vdinit of the display image of the present frame to the pixel circuit 10 before the initialization phase 1 corresponding to the display image of the present frame, so as to prevent the data signal of the display image of the previous frame from being written into the first terminal 110 of the driving circuit 100.

As illustrated in FIG. 4 and FIG. 5, in the initialization phase 1, the second transistor T2, the third transistor T3, and the fourth transistor T4 are turned on by the low level of the scanning signal Gate_N, and the sixth transistor T6 is turned on by the low level of the second light-emitting control signal EM2. Simultaneously, the fifth transistor T5 is turned off by the high level of the first light-emitting control signal EM1.

As illustrated in FIG. 5, in the initialization phase 1, the pixel circuit 10 forms two initialization paths (as illustrated by dashed lines with arrows in FIG. 5). In this phase, the storage capacitor C and the gate electrode of the first transistor T1 discharge through the fourth transistor T4, the sixth transistor T6, and the third transistor T3, the second electrode (that is, the second node N2) of the first transistor T discharges through the sixth transistor T6 and the third transistor T3, and the light-emitting component L1 discharges through the third transistor T3, thereby allowing the third node N3, the second node N2, and the light-emitting component L1 (that is, the fourth node N4) to be reset. Therefore, after the initialization phase 1, the levels of the second node N2, the third node N3, and the fourth node N4 are the reset voltage Vinit (a low-level voltage signal, which can be grounded or other low-level signals). Simultaneously, in this phase, the data initial voltage Vdinit is applied to the first electrode (i.e., the first node N1) of the first transistor T1 through the second transistor T2, thereby allowing the voltage of the first node N1 to be refreshed. Therefore, after the initialization phase 1, the level of the first node N1 is the data initial voltage Vdinit. In this phase, because the first transistor T1, the second transistor T2, and the sixth transistor T6 are turned on, and the fifth transistor T5 is turned off, according to the characteristics of the first transistor T1, the voltage $V_{GS}$ between the gate electrode (i.e., the third node N3) of the first transistor T1 and the first electrode (i.e., the source electrode and the first node N1) of the first transistor T1 is maintained at a fixed value, that is, $V_{GS}$=Vinit-Vdinit, so that the working state of the first transistor T1 is refreshed to avoid the short-term image retention due to the previous frame. With this configuration, regardless of whether the data signal Vdata of the previous frame is a black state signal or a white state signal, the first transistor T1 is in a refreshed state to start the data writing phase 2, thereby alleviating the short-term image retention caused by hesitation effect in the display panel where the pixel circuit 10 is used.

After the initialization phase 1, the level of the third node N3 is the reset voltage Vinit, and the level of the first node N1 is the data initial voltage Vdinit. In the initialization phase 1, the capacitor C is reset, and the voltage stored in the capacitor C is discharged, so that the data signal Vdata can be stored in the capacitor C more quickly and reliably in the subsequent phases. Simultaneously, the second node N2 and the light-emitting component L1 (i.e., the fourth node N4) are also reset, so that the light-emitting component L1 displays in a black state and does not emit light before the light-emitting phase 3, thereby improving the display effect, such as the contrast, of the display panel using the pixel circuit 10 described above.

In the data writing phase 2, the scanning signal Gate_N is input to turn on the data writing circuit 200, the driving circuit 100, and the compensation circuit 300. The data writing circuit 200 writes the data signal Vdata into the driving circuit 100, and the compensation circuit 300 stores the data signal Vdata and performs compensation on the driving circuit 100.

As illustrated in FIG. 4 and FIG. 6, in the data writing phase 2, the second transistor T2, the third transistor T3, and the fourth transistor T4 are turned on by the low level of the scanning signal Gate_N. Simultaneously, the fifth transistor T5 is turned off by the high level of the first light-emitting control signal EM1, and the sixth transistor T6 is turned off by the high level of the second light-emitting control signal EM2.

As illustrated in FIG. 6, in the data writing phase 2, the pixel circuit 10 forms a data writing and compensation path (as illustrated by the dashed line 1 with an arrow in FIG. 6) and a reset path (as illustrated by the dashed line 2 with an arrow in FIG. 6). The data signal Vdata charges the third node N3 (that is, charges the capacitor C) after passing through the second transistor T2, the first transistor T1, and the fourth transistor T4, so that the level of the third node N3 is increased. It is easy to understand that the level of the first node N1 is maintained at Vdata, and according to the characteristics of the first transistor T1, where the level of the third node N3 is increased to Vdata+Vth, the first transistor T1 is turned off and the charging process ends. It should be noted that Vdata can represent the value of the voltage of the data signal, and Vth represents the threshold voltage of the first transistor T1. In this embodiment, the first transistor T1 is described by taking a P-type transistor as an example, so that the threshold voltage Vth may be a negative value. Simultaneously, in this phase, the fourth node N4 keeps discharging through the third transistor T3, so the voltage of the fourth node N4 is still the reset voltage Vinit. It should be noted that, in this phase, the reset circuit 300 may also be turned off in response to other signals, which may not affect the subsequent light-emitting phase of the pixel circuit 10, and the embodiments of the present disclosure are not limited in this aspect.

It should be noted that, in the embodiments illustrated in FIG. 3 and FIG. 4, the data signal Vdata may be a high-level signal, and in some other embodiments of the present disclosure, the data signal Vdata may also be a low-level signal. For example, the data signal Vdata may also be a negative value. For example, in the data writing phase 2, the data signal Vdata passes through the second transistor T2, the first transistor T1, and the fourth transistor T4 to discharge the third node N3 (that is, the capacitor C is discharged), so that the level of the third node N3 is reduced. The level of the first node N1 is maintained at Vdata, and according to the characteristics of the first transistor T1, where the level of the third node N3 is reduced to Vdata+Vth, the first transistor T1 is turned off and the discharging process ends.

After the data writing phase 2, the levels of the second node N2 and the third node N3 are both Vdata+Vth, that is, the voltage information including the data signal Vdata and the threshold voltage Vth of the first transistor T1 is stored in the capacitor C, so as to be used to provide the gray-level display data to the light-emitting component L1 and perform compensation on the threshold voltage Vth of the first transistor T1 in the subsequent light-emitting phase.

It should be noted that, as illustrated in FIG. 4, the data line continues to provide the data signal Vdata to the pixel circuit 10 for a period of time after the data writing phase 2, so as to ensure that in the case where the pixel circuit 10 starts the subsequent phase from the data writing phase 2, for example, at the moment when the data writing phase 2 ends, the target signal Vdata is written into the control terminal 130 (i.e., the third node N3) of the driving circuit 100, thereby allowing the subsequent light-emitting phase to acquire the desired display effect.

In the light-emitting phase 3, the first light-emitting control signal EM1 and the second light-emitting control signal EM2 are input to turn on the first light-emitting control circuit 500, the second light-emitting control circuit 600, and the driving circuit 100, the driving current flows through the first terminal 110 and the second terminal 120 of the driving circuit 100, and the second light-emitting control circuit 600 applies the driving current to the light-emitting component L, so as to drive the light-emitting component L1 to emit light.

As illustrated in FIG. 4 and FIG. 7, in the light-emitting phase 3, the fifth transistor T5 is turned on by the low level of the first light-emitting control signal EM1, and the sixth transistor T6 is turned on by the low level of the second light-emitting control signal EM2. Simultaneously, the second transistor T2, the third transistor T3, and the fourth transistor T4 are turned off by the high level of the scanning signal Gate_N. Simultaneously, the level of the third node N3 is Vdata+Vth, and the level of the first node N1 is VDD (VDD may represent the level of the first voltage), so that the first transistor T1 is also turned on in the light-emitting phase 3.

As illustrated in FIG. 7, in the light-emitting phase 3, a driving light-emitting path (as illustrated by the dashed line with an arrow in FIG. 7) is formed. The light-emitting component L1 can emit light under the action of the driving current flowing through the first transistor T1.

Specifically, the value of the driving current $I_{L1}$ flowing through the light-emitting component L1 can be obtained according to the following formula:

$$\begin{aligned} I_{L1} &= 1/2K(V_{GS} - Vth)^2 \\ &= 1/2K[Vdata + Vth - VDD) - Vth]^2 \\ &= 1/2K[Vdata - VDD)^2, \end{aligned}$$

where $$K = W^* C_{OX}^* U / L.$$

In the above formula, Vth represents the threshold voltage of the first transistor T1, $V_{GS}$ represents the voltage between the gate electrode and the source electrode (here the first electrode) of the first transistor T1, and K is a constant value related to the driving transistor (the first transistor T1 in the embodiments of the present disclosure). It can be seen from the above calculation formula of $I_{L1}$ that the driving current $I_{L1}$ flowing through the light-emitting component L is no longer related to the threshold voltage Vth of the first transistor T1, so that the pixel circuit 10 can be compensated, the problem of the drift of the threshold voltage Vth, which is caused by the manufacturing process and long-term operation, of the driving transistor is solved, and the influence on the driving current $I_{L1}$ is eliminated, thereby improving the display effect of the display panel using the pixel circuit 10.

Figure 8:
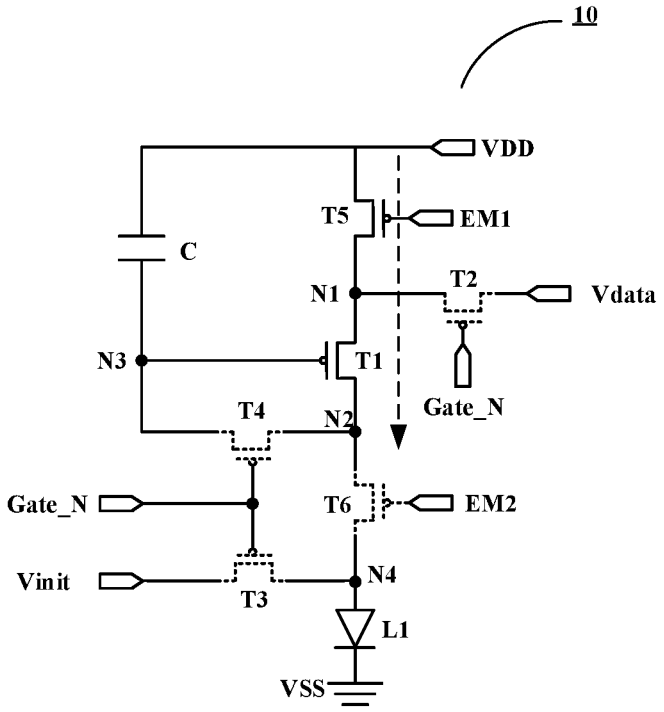

For example, with reference to the signal timing diagram illustrated in FIG. 4, the pixel circuit 10 illustrated in FIG. 3 may further include a pre-light-emitting phase 4 between the data writing phase 2 and the light-emitting phase 3. FIG. 8 is a schematic diagram of the pixel circuit 10 illustrated in FIG. 3 in the pre-light-emitting phase 4.

In the pre-light-emitting phase 4, the first light-emitting control signal EM1 is input to turn on the first light-emitting control circuit 500 and the driving circuit 100, and the first light-emitting control circuit 500 applies the first voltage of the first voltage terminal VDD to the first terminal 110 of the driving circuit 100.

As illustrated in FIG. 4 and FIG. 8, in the pre-light-emitting phase 4, the fifth transistor T5 is turned on by the low level of the first light-emitting control signal EM1. Simultaneously, the second transistor T2, the third transistor T3, and the fourth transistor T4 are turned off by the high level of the scanning signal Gate_N, the sixth transistor T6 is turned off by the high level of the second light-emitting control signal EM2, and the first transistor T1 remains turned on.

As illustrated in FIG. 8, in the pre-light-emitting phase 4, a pre-light-emitting path is formed (as illustrated by the dashed line with an arrow in FIG. 8). The first voltage terminal VDD charges the first node N1 through the fifth transistor T5, and the level of the first node N1 changes from Vdata to the first voltage VDD. Because the sixth transistor T6 is turned off in this phase, the light-emitting component L does not emit light in the pre-light-emitting phase 4 and prepares for emitting light in the next phase.

Figure 9:
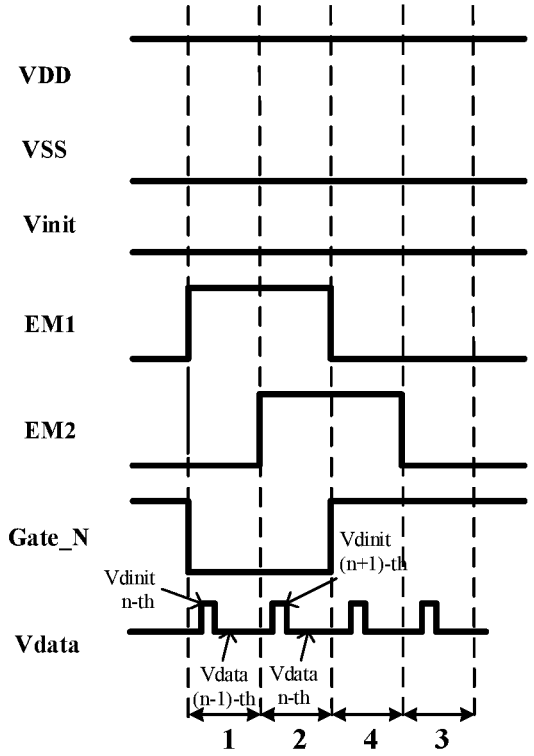
FIG. 9 is a signal timing diagram of another pixel circuit provided by some embodiments of the present disclosure.

It should be noted that the pixel circuit 10 according to the embodiments of the present disclosure may be arranged in an array, for example, in a display panel, and each column of pixel circuits 10 are connected to the same data line. FIG. 9 is another signal timing diagram corresponding to the pixel circuit 10 illustrated in FIG. 3. As illustrated in FIG. 9, in the case where a plurality of pixel circuits 10 in the same column are connected to one data line, the data line can provide different corresponding data signals Vdata to the plurality of pixel circuits 10, and the data initial voltage Vdinit provided to the pixel circuits 10 in each row is the same, so that the problem of the short-term image retention caused by hesitation effect in the display panel using the pixel circuit 10 can be alleviated.

For example, as illustrated in FIG. 9, in the initialization phase 1 corresponding to the pixel circuit 10 in the n-th row, the data line provides the data initial voltage Vdinit to the pixel circuit 10 in the n-th row and provides the corresponding (n−1)-th data signal to the pixel circuit 10 in the (n−1)-th row (where the pixel circuit 10 in the (n−1)-th row is in the data writing phase). In the data writing phase 2 corresponding to the pixel circuit 10 in the n-th row, the data line provides the corresponding n-th data signal to the pixel circuit 10 in the n-th row and provides the data initial voltage Vdinit to the pixel circuit 10 in the (n+1)-th row (where the pixel circuit 10 in the (n+1)-th row is in the initialization phase). For example, the pixel circuits 10 in the (n−1)-th row and the (n+1)-th row and the pixel circuit 10 in the n-th row may correspond to different data signals, respectively. It should be noted that, for the pixel circuit 10 in the n-th row, in the data writing phase 2, the signal provided by the data line is changed from Vdinit to Vdata, so that the data signal finally written into the pixel circuit 10 in the n-th row is Vdata, and the change in the signal of the data line does not affect the data signal actually written into the pixel circuit 10.

It should be noted that all the transistors used in the embodiments of the present disclosure may be thin film transistors, field effect transistors, or other switching components with the same characteristics. In the embodiments of the present disclosure, the thin film transistors are taken as an example for description. The source electrode and the drain electrode of the transistor used here can be symmetrical in structure, so there can be no difference in structure of the source electrode and the drain electrode of the transistor. In the embodiments of the present disclosure, in order to distinguish the two electrodes of the transistor other than the gate electrode, one electrode is directly described as the first electrode and the other electrode is the second electrode.

In addition, it should be noted that the transistors in the pixel circuit 10 illustrated in FIG. 3 are described by taking that the first to sixth transistors T1, T2, T3, T4, T5, and T6 are P-type transistors as an example. In this case, the first electrode may be a source electrode and the second electrode may be a drain electrode. It should be noted that the embodiments of the present disclosure include this case but are not limited thereto. For example, one or more transistors in the pixel circuit 10 provided by the embodiments of the present disclosure may also be N-type transistors. In this case, the first electrode of the transistor is the drain electrode, and the second electrode is the source electrode. The electrodes of the transistor of the selected type are connected with reference to the electrodes of the corresponding transistor in the embodiments of the present disclosure, and the corresponding voltage terminal may provide a corresponding high voltage or low voltage. Where the N-type transistor is used, indium gallium zinc oxide (IGZO) can be used as the active layer of the thin film transistor. Compared with that low temperature poly silicon (LTPS) or amorphous silicon (e.g., hydrogenated amorphous silicon) is used as the active layer of the thin film transistor, the IGZO can effectively reduce the size of the transistor and prevent leakage current.

Figure 10:
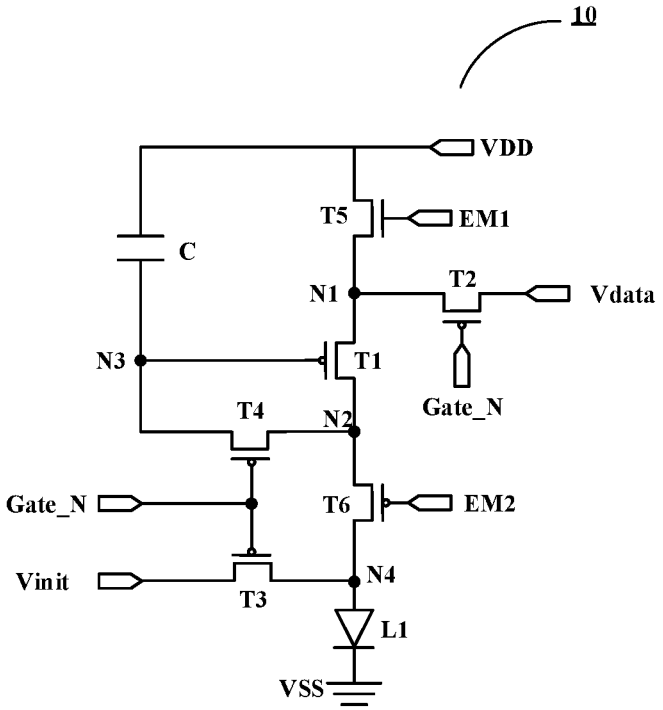
FIG. 10 is a circuit diagram of another specific example of the pixel circuit illustrated in FIG. 2.

For example, FIG. 10 is a circuit diagram of another specific example of the pixel circuit 10 illustrated in FIG. 2. As illustrated in FIG. 10, except that the fifth transistor T5 is an N-type transistor, the first transistor T1, the second transistor T2, the third transistor T3, the fourth transistor T4, and the sixth transistor T6 are all P-type transistors, and the connection of each transistor is basically the same as that of each transistor in the pixel circuit 10 illustrated in FIG. 3.

As illustrated in FIG. 10, the gate electrode of the fifth transistor T5 is connected to the first light-emitting control line to receive the first light-emitting control signal EM1, the first electrode of the fifth transistor T5 is connected to the first voltage terminal VDD to receive the first voltage, and the second electrode of the fifth transistor T5 is connected to the first terminal 110 (the first node N1) of the driving circuit 100. For example, the fifth transistor T5 is turned on in response to the high level of the first light-emitting control signal EM1 and is turned off in response to the low level of the first light-emitting control signal EM1.

Figure 11:
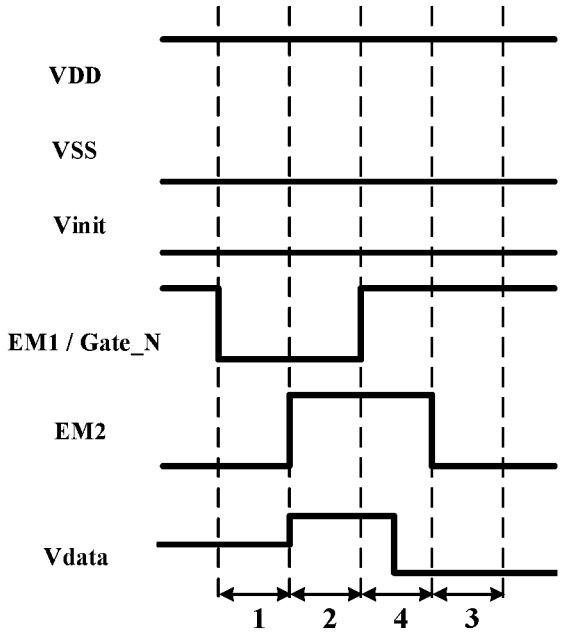
FIG. 11 is a signal timing diagram of another pixel circuit provided by some embodiments of the present disclosure.

FIG. 11 is a signal timing diagram corresponding to the pixel circuit 10 illustrated in FIG. 10. As illustrated in FIG. 11, the scanning signal Gate_N and the first light-emitting control signal EM1 may have the same waveform and the same phase, that is, the scanning signal Gate_N and the first light-emitting control signal EM1 may be one signal. Therefore, the scanning signal Gate_N and the first light-emitting control signal EM1 can be provided by the same signal output terminal of the gate driving circuit, thereby further reducing the layout space required for the gate driving circuit and simplifying the manufacturing process. The working principle of the pixel circuit 10 according to the signal timing illustrated in FIG. 11 is similar to the working principle of the pixel circuit 10 illustrated in FIG. 3 according to the signal timing illustrated in FIG. 4, and can be with reference to the above description, and details are not described herein again.

For example, as illustrated in FIG. 3, the cathode of the light-emitting component L1 in the pixel circuit 10 is connected to the second voltage terminal VSS to receive the second voltage. For example, in a display panel, where the pixel circuit 10 illustrated in FIG. 3 is arranged in an array, the cathode of the light-emitting component L may be electrically connected to the same voltage terminal, that is, a common cathode connection is used.

It should be noted that the signal timing diagram illustrated in FIG. 4 is the case where the second light-emitting control signal EM2 and the first light-emitting control signal EM1 have the same waveform but have different phases provided by some embodiments of the present disclosure. In some other embodiments of the present disclosure, the waveform of the second light-emitting control signal EM2 may be different from the waveform of the first light-emitting control signal EM1.

Figure 12:
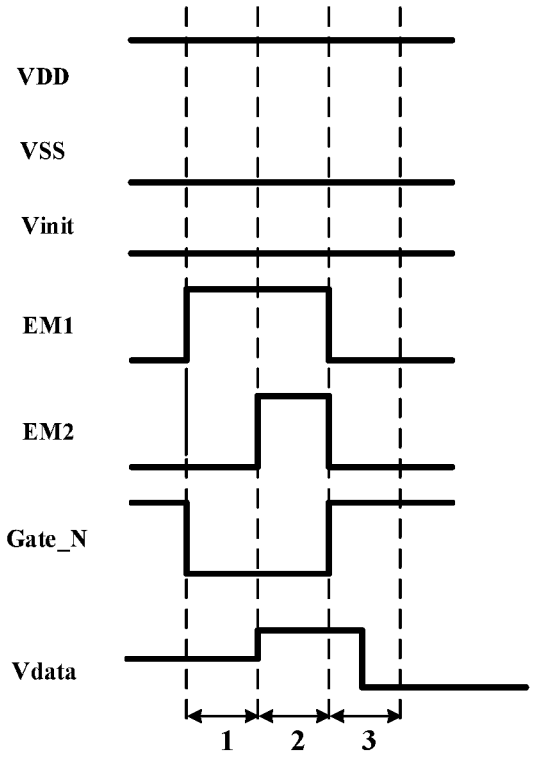
FIG. 12 is a signal timing diagram of still another pixel circuit provided by some embodiments of the present disclosure.

FIG. 12 is another signal timing diagram of the pixel circuit 10 provided by some embodiments of the present disclosure. As illustrated in FIG. 12, for the pixel circuit 10 illustrated in FIG. 3, in the case where the falling edge of the second light-emitting control signal EM2 coincides with the falling edge of the first light-emitting control signal EM1, the display process of each frame may include three phases: the initialization phase 1, the data writing phase 2, and the light-emitting phase 3, so that the pixel circuit 10 can directly start the light-emitting phase 3 from the data writing phase 2 without going through the pre-light-emitting phase 4. The working principle of the pixel circuit 10 according to the signal timing illustrated in FIG. 12 is similar to the working principle of that according to the signal timing illustrated in FIG. 4, and can be with reference to the above description, and details are not described herein again.

At least one embodiment of the present disclosure further provides a display panel including a plurality of pixel units arranged in a plurality of rows and a plurality of columns, and each of the pixel units includes the pixel circuit provided by any one of the embodiments of the present disclosure. The driving signals (such as the first light-emitting control signal and the scanning signal) required for the pixel circuit in the display panel can be output by a same gate driving circuit, thereby reducing the layout space required for the gate driving circuit, allowing the frame size of the display panel to be reduced, facilitating implementing a narrow frame, and reducing the production cost.

Figure 13:
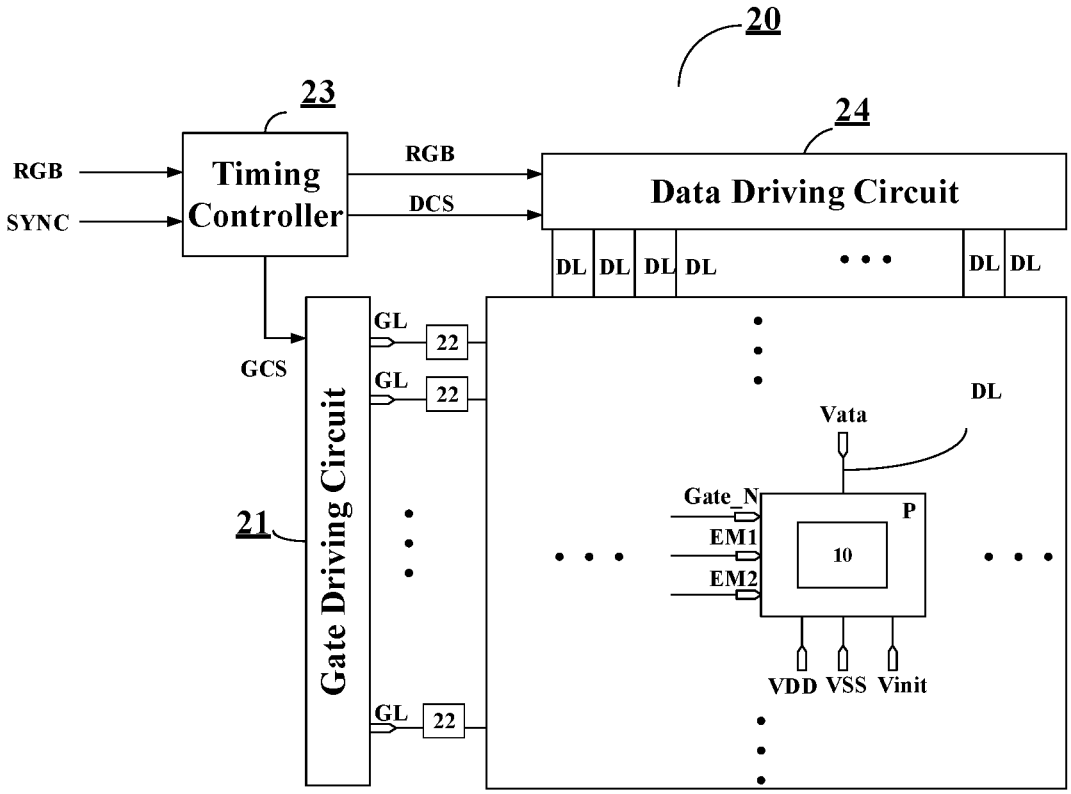
FIG. 13 is a schematic diagram of a display panel provided by some embodiments of the present disclosure.

FIG. 13 is a schematic diagram of a display panel 20 provided by some embodiments of the present disclosure. As illustrated in FIG. 13, the display panel 20 includes a plurality of pixel units P arranged in a plurality of rows and a plurality of columns, and each of the pixel units P may include, for example, the pixel circuit 10 illustrated in FIG. 1 or FIG. 2.

For example, as illustrated in FIG. 13, the display panel 20 further includes a gate driving circuit 21 and a plurality of signal control units 22. The gate driving circuit 21 includes a plurality of gate driving signal output terminals GL. The plurality of gate driving signal output terminals GL are connected to the plurality of signal control units 22 in one-to-one correspondence, and each gate driving signal output terminal GL and each signal control unit 22 correspond to one row of pixel units P to provide the scanning signal Gate_N and the first light-emitting control signal EM1. In addition, in the case where the pixel circuit 10 in the pixel unit P further includes the second light-emitting control circuit 600, the signal control unit 22 further provides the second light-emitting control signal EM2 to the pixel units P in the adjacent previous row while providing the scanning signal Gate_N and the first light-emitting control signal EM1 to the pixel units P in the present row. As described above, the embodiments of the present disclosure do not limit the type and specific structure of the gate driving circuit 21.

Figure 14:
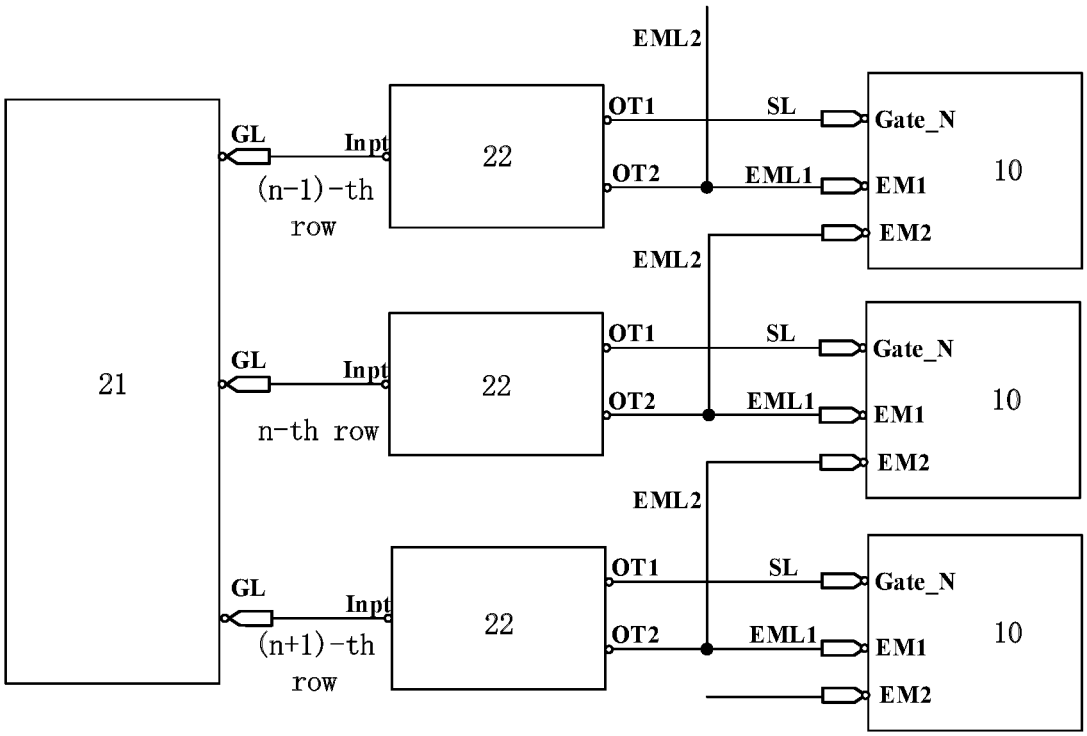
FIG. 14 is a schematic diagram of a signal control unit provided by some embodiments of the present disclosure.

FIG. 14 is a schematic diagram of the signal control unit 22 provided by some embodiments of the present disclosure. As illustrated in FIG. 14, the signal control unit 22 includes a signal input terminal Inpt, a first signal output terminal OT1, and a second signal output terminal OT2, the signal input terminal Inpt of the signal control unit 22 is connected to a corresponding gate driving signal output terminal GL of the gate driving circuit 21 to receive the gate driving signal, and the signals provided by the first signal output terminal OT1 and the second signal output terminal OT2 of the signal control unit 22 have inverting phases.

For example, as illustrated in FIG. 14, the first signal output terminal OT1 of the n-th signal control unit 22 provides the scanning signal Gate_N to the pixel circuit 10 of each pixel unit P in the n-th row through the scanning line SL, the second signal output terminal OT2 of the n-th signal control unit 22 provides the first light-emitting control signal EM1 to the pixel circuit 10 of each pixel unit P in the n-th row through the first light-emitting control line EML1, and n is an integer greater than 0.

For example, in the case where the pixel circuit 10 in the pixel unit P further includes the second light-emitting control circuit 600, the second signal output terminal OT2 of the (n+1)-th signal control unit 22 further provides the second light-emitting control signal EM2 to the pixel circuit 10 of each pixel unit P in the n-th row through the second light-emitting control line EML2. The manner of allowing the light-emitting control signal to be used for both the previous row and the present row or for both the present row and the next row can further simplify the layout space of the gate driving circuit of the display panel 20, and greatly reduce the frame size of the display panel 20.

It should be noted that, in the embodiments illustrated in FIG. 14, the signals provided by the first signal output terminal OT1 and the second signal output terminal OT2 of the signal control unit 22 have inverting phases. In some other embodiments of the present disclosure, the signals provided by the first signal output terminal OT1 and the second signal output terminal OT2 of the signal control unit 22 may also have other phase relationships with each other, and the embodiments of the present disclosure include this case but are not limited thereto.

Figure 15:
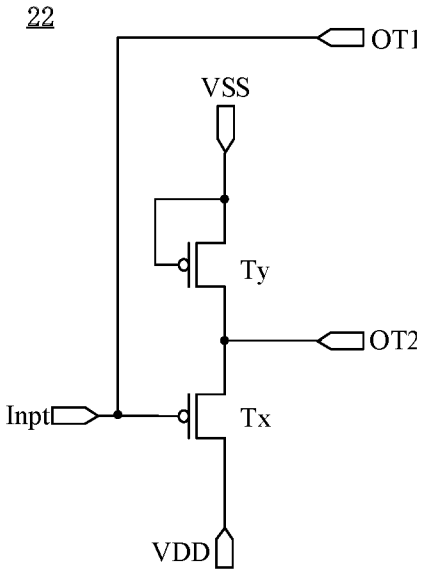
FIG. 15 is a circuit diagram of a specific example of the signal control unit illustrated in FIG. 14.

For example, the signal control unit 22 illustrated in FIG. 14 may be implemented by a phase inverting circuit. FIG. 15 is a circuit diagram of a specific example of the signal control unit 22 illustrated in FIG. 14. As illustrated in FIG. 15, the signal control unit 22 includes a phase inverting circuit, and the phase inverting circuit is configured to invert the phase of the gate driving signal received by the signal input terminal Inpt of the signal control unit 22 and output a signal which is obtained by inverting the phase of the gate driving signal through the second signal output terminal OT2 of the signal control unit 22.

For example, as illustrated in FIG. 15, the phase inverting circuit includes a first inverting transistor Tx and a second inverting transistor Ty. A gate electrode of the first inverting transistor Tx is connected to the signal input terminal Inpt, a first electrode of the first inverting transistor Tx is connected to the first voltage terminal VDD, and a second electrode of the first inverting transistor Tx is connected to the second signal output terminal OT2. A gate electrode and a second electrode of the second inverting transistor Ty are connected to, for example, the second voltage terminal VSS, and a first electrode of the second inverting transistor Ty is connected to the second signal output terminal OT2. For example, the first inverting transistor Tx and the second inverting transistor Ty are both P-type transistors. Where a high-level signal is input to the signal input terminal Inpt, the first inverting transistor Tx is turned off, the second inverting transistor Ty is turned on, and the second signal output terminal OT2 outputs a low-level signal. Where a low-level signal is input to the signal input terminal Inpt, the first inverting transistor Tx is turned on, and the second inverting transistor Ty remains turned on. By properly designing the respective width-to-length ratios of channels of the first inverting transistor Tx and the second inverting transistors Ty, a high-level signal can be output by the second signal output terminal OT2. Thereby, the signal output from the second signal output terminal OT2 and the signal input to the signal input terminal Inpt have inverting phases. Because the first signal output terminal OT1 is connected to the signal input terminal Inpt, the signals output by the first signal output terminal OT1 and the second signal output terminal OT2 also have inverting phases. It should be noted that the signal control unit 22 may also be implemented by a plurality of inverting circuits or other types of circuit structures, and the transistors of these circuits may be P-type or N-type transistors. The implementation of the signal control unit 22 in the embodiments of the present disclosure include but are not limited to the above.

It should be noted that, in the case where the pixel circuit 10 is implemented by the manner illustrated in FIG. 10, because the scanning signal Gate_N and the first light-emitting control signal EM1 are the same signal, the scanning signal Gate_N and the first light-emitting control signal EM1 can be simultaneously provided by the same signal output terminal GL of the gate driving circuit 21, and the plurality of gate driving signal output terminals GL of the gate driving circuit 21 can be directly connected to the corresponding scanning lines SL and the corresponding first light-emitting control lines EML1, respectively, so that the signal control unit 22 can be eliminated. For example, in some embodiments, the scanning line SL and the first light-emitting control line EML1 corresponding to each row may also be one signal line, and the signal line is connected to the corresponding transistors in the pixel circuit 10 to provide the scanning signal Gate_N and the first light-emitting control signal EM1.

For example, in the display panel 20 illustrated in FIG. 13, the driving signals required for each of the pixel circuits 10 of the display panel 20 can be output by one gate driving circuit 21 through the plurality of signal control units 22 described above, thereby reducing the layout space required for the gate driving circuit of the display panel 20 and allowing the frame size of the display panel 20 to be greatly reduced.

For example, as illustrated in FIG. 13, the first voltage terminal VDD or the second voltage terminal VSS of the pixel circuit 10 in each pixel unit P may be replaced by a corresponding common electrode (such as a common anode or a common cathode) in a plate shape.

For example, as illustrated in FIG. 13, the display panel 20 may further include a timing controller 23 and a data driving circuit 24. The data driving circuit 24 is configured to drive a plurality of data lines DL, so as to provide the data signal Vdata to the pixel circuit 10 in each pixel unit P. The timing controller 23 is used to process the image data RGB input from the outside of the display panel 20, provide the processed image data RGB to the data driving circuit 24, and output the scanning control signal GCS and data control signal DCS to the gate driving circuit 21 and the data driving circuit 24, so as to control the gate driving circuit 21 and the data driving circuit 24.

For example, the gate driving circuit 21 provides a plurality of turn-on signals (i.e., gate driving signals) to the plurality of gate driving signal output terminals GL of the gate driving circuit 21 according to the plurality of scanning control signals GCS from the timing controller 23.

For example, the data driving circuit 24 converts the digital image data RGB input from the timing controller 23 into the data signal Vdata according to the plurality of data control signals DCS from the timing controller 23 by using a reference gamma voltage. The data driving circuit 24 provides the converted data signals Vdata to the plurality of data lines DL.

For example, the timing controller 23 processes the image data RGB externally input to match the size and resolution of the display panel 20, and then provides the processed image data RGB to the data driving circuit 24. The timing controller 23 generates the plurality of scanning control signals GCS and the plurality of data control signals DCS by using synchronization signals (such as a dot clock DCLK, a data enable signal DE, a horizontal synchronization signal Hsync, and a vertical synchronization signal Vsync) input from the outside of the display panel 20. The timing controller 23 provides the generated scanning control signals GCS and data control signals DCS to the gate driving circuit 21 and the data driving circuit 24, respectively, for controlling the gate driving circuit 21 and the data driving circuit 24.

For example, the data driving circuit 24 may be connected to the plurality of data lines DL to provide the data signals Vdata, and may also be connected to a plurality of first voltage lines, a plurality of second voltage lines, and a plurality of reset voltage lines to provide the first voltage VDD, the second voltage VSS, and the reset voltage Vinit, respectively.

For example, the gate driving circuit 21 and the data driving circuit 24 may be implemented as a semiconductor chip. The display panel 20 may further include other components, such as a signal decoding circuit, a voltage conversion circuit, etc. For example, these components may use existing conventional components, and details are not described herein again.

For example, the display panel 20 provided by the embodiments can be applied to any product or component having a display function, such as an electronic paper, a mobile phone, a tablet computer, a television, a display, a notebook computer, a digital photo frame, a navigator, etc. The technical effects of the display panel 20 can be with reference to the technical effects of the pixel circuit 10 provided by the embodiments of the present disclosure, and details are not described herein again.

At least one embodiment of the present disclosure further provides a method that can be used to drive the pixel circuit 10 provided by the embodiments of the present disclosure.

For example, in an example, the pixel circuit 10 is illustrated in FIG. 1, and the method includes the following steps.

In the data writing phase, the scanning signal Gate_N is input to turn on the data writing circuit 200, so as to allow the data writing circuit 200 to write the data signal Vdata into the driving circuit 100, and the first light-emitting control signal EM1 provided by a same gate driving circuit with the scanning signal Gate_N is input to turn off the first light-emitting control circuit 500.

In the light-emitting phase, the first light-emitting control signal EM1 is input to turn on the first light-emitting control circuit 500 and the driving circuit 100, the first light-emitting control circuit 500 applies the first voltage VDD to the first terminal 110 of the driving circuit 100, and the driving current flows through the first terminal 110 and the second terminal 120 of the driving circuit 100 and further flows through the light-emitting component 700 to drive the light-emitting component 700 to emit light.

For example, the first light-emitting control signal EM1 and the scanning signal Gate_N are provided by the same gate driving circuit.

For example, in some embodiments of the present disclosure, in the case where the pixel circuit 10 includes the compensation circuit 400, the method may further include the following steps in the data writing phase.

In the data writing phase, the scanning signal Gate_N is input to turn on the data writing circuit 200, the driving circuit 100, and the compensation circuit 400, and the compensation circuit 400 stores the data signal Vdata and performs compensation on the driving circuit 100.

For example, in some embodiments of the present disclosure, in the case where the pixel circuit 10 includes the reset circuit 300, the method may further include an initialization phase.

In the initialization phase, the scanning signal Gate_N is input to turn on the reset circuit 300 and the compensation circuit 400, and the reset voltage Vinit is applied to the control terminal 130 of the driving circuit 100 and the light-emitting component 700.

For example, in another example, the pixel circuit 10 is illustrated in FIG. 2, and in the case where the pixel circuit 10 includes the second light-emitting control circuit 600, the method further includes the following steps.

In the light-emitting phase, the second light-emitting control signal EM2 is input to turn on the second light-emitting control circuit 600.

For example, the second light-emitting control signal EM2, the first light-emitting control signal EM, and the scanning signal Gate_N are provided by the same gate driving circuit, and the second light-emitting control signal EM2 and the first light-emitting control signal EM1 have the same waveform but have different phases. For example, in some embodiments of the present disclosure, the first light-emitting control signal EM1 and the scanning signal Gate_N are the same signal, that is, the first light-emitting control signal EM1 and the scanning signal Gate_N have the same waveform and the same phase.

For example, in the case where the pixel circuit 10 includes the second light-emitting control circuit 600, the method further includes: inputting the second light-emitting control signal EM2 to turn on the second light-emitting control circuit 600 in the initialization phase.

For example, in some embodiments of the present disclosure, the method may further include a pre-light-emitting phase.

In the pre-light-emitting phase, the first light-emitting control signal EM1 is input to turn on the first light-emitting control circuit 500, and the first voltage VDD is applied to the first terminal 110 of the driving circuit 100 through the first light-emitting control circuit 500.

It should be noted that, detailed descriptions of the method can be with reference to the descriptions of the working principle of the pixel circuit 10 in the embodiments of the present disclosure, and details are not described herein again.

The method provided by the embodiments can allow the driving signals required for the pixel circuit 10 to be output by the same gate driving circuit, thereby reducing the layout space required for the gate driving circuit, greatly reducing the frame size of the display panel, facilitating implementing a narrow frame, and reducing the production cost.

The following statements should be noted.

(1) The accompanying drawings involve only the structure(s) in connection with the embodiment(s) of the present disclosure, and other structure(s) can be referred to common design(s).

(2) In case of no conflict, features in one embodiment or in different embodiments can be combined to obtain new embodiments.

What have been described above are only specific implementations of the present disclosure, the protection scope of the present disclosure is not limited thereto, and the protection scope of the present disclosure should be based on the protection scope of the claims.

What is claimed is:

1. A pixel circuit, comprising: a driving circuit, a data writing circuit, and a first light-emitting control circuit, wherein the driving circuit comprises a control terminal, a first terminal, and a second terminal, and the driving circuit is configured to control a driving current flowing through the first terminal and the second terminal for driving a light-emitting component to emit light;

the data writing circuit is connected to the first terminal of the driving circuit, and is configured to write a data signal into the driving circuit in response to a scanning signal; and the first light-emitting control circuit is connected to the first terminal of the driving circuit and a first voltage terminal, and is configured to apply a first voltage of the first voltage terminal to the first terminal of the driving circuit in response to a first light-emitting control signal, and the first light-emitting control signal and the scanning signal are provided by a same gate driving circuit.

2. The pixel circuit according to claim 1, wherein the first light-emitting control signal and the scanning signal have inverting phases.

3. The pixel circuit according to claim 1, further comprising a second light-emitting control circuit, wherein the second light-emitting control circuit is connected to the second terminal of the driving circuit and the light-emitting component, and is configured to apply the driving current to the light-emitting component in response to a second light-emitting control signal.

4. The pixel circuit according to claim 3, wherein the second light-emitting control signal, the first light-emitting control signal, and the scanning signal are provided by the same gate driving circuit, and the second light-emitting control signal and the first light-emitting control signal have an identical waveform but have different phases.

5. The pixel circuit according to claim 1, further comprising a compensation circuit, wherein the compensation circuit is connected to the control terminal of the driving circuit, the second terminal of the driving circuit, and the first voltage terminal, and is configured to store the data signal written by the data writing circuit, cooperate with the data writing circuit to write the data signal into the control terminal of the driving circuit in response to the scanning signal, and perform compensation on the driving circuit.

6. The pixel circuit according to claim 5, further comprising a reset circuit, wherein the reset circuit is connected to a reset voltage terminal, and is configured to apply a reset voltage of the reset voltage terminal to the light-emitting component in response to the scanning signal and apply the reset voltage to the control terminal of the driving circuit through the compensation circuit.

7. The pixel circuit according to claim 1, wherein the driving circuit comprises a first transistor, a gate electrode of the first transistor serves as the control terminal of the driving circuit, a first electrode of the first transistor serves as the first terminal of the driving circuit, and a second electrode of the first transistor serves as the second terminal of the driving circuit.

8. The pixel circuit according to claim 1, wherein the data writing circuit comprises a second transistor, a gate electrode of the second transistor is connected to a scanning line to receive the scanning signal, a first electrode of the second transistor is connected to a data line to receive the data signal, and a second electrode of the second transistor is connected to the first terminal of the driving circuit.

9. The pixel circuit according to claim 6, wherein the reset circuit comprises a third transistor, a gate electrode of the third transistor is connected to a scanning line to receive the scanning signal, a first electrode of the third transistor is connected to the light-emitting component, and a second electrode of the third transistor is connected to the reset voltage terminal to receive the reset voltage.

10. The pixel circuit according to claim 5 wherein the compensation circuit comprises a fourth transistor and a capacitor;

a gate electrode of the fourth transistor is connected to a scanning line to receive the scanning signal, a first electrode of the fourth transistor is connected to the second terminal of the driving circuit, and a second electrode of the fourth transistor is connected to the control terminal of the driving circuit; and a first electrode of the capacitor is connected to the control terminal of the driving circuit, and a second electrode of the capacitor is connected to the first voltage terminal.

11. The pixel circuit according to claim 1, wherein the first light-emitting control circuit comprises a fifth transistor, a gate electrode of the fifth transistor is connected to a first light-emitting control line to receive the first light-emitting control signal, a first electrode of the fifth transistor is connected to the first voltage terminal to receive the first voltage, and a second electrode of the fifth transistor is connected to the first terminal of the driving circuit.

12. The pixel circuit according to claim 3, wherein the second light-emitting control circuit comprises a sixth transistor, a gate electrode of the sixth transistor is connected to a second light-emitting control line to receive the second light-emitting control signal, a first electrode of the sixth transistor is connected to the second terminal of the driving circuit, and a second electrode of the sixth transistor is connected to the light-emitting component.

13. A display panel, comprising a plurality of pixel units arranged in a plurality of rows and a plurality of columns, wherein each of the pixel units comprises the pixel circuit according to claim 1.

14. The display panel according to claim 13, further comprising a gate driving circuit and a plurality of signal control units, wherein the gate driving circuit comprises a plurality of gate driving signal output terminals, and the plurality of gate driving signal output terminals are in one-to-one correspondence with the plurality of signal control units;

each of the gate driving signal output terminals and each of the signal control units correspond to pixel units in one row to provide the scanning signal and the first light-emitting control signal;

at least one signal control unit of the plurality of signal control units comprises a signal input terminal, a first signal output terminal, and a second signal output terminal, the signal input terminal of the signal control unit is connected to a corresponding gate driving signal output terminal to receive a gate driving signal, and a signal provided by the first signal output terminal of the signal control unit and a signal provided by the second signal output terminal of the signal control unit have inverting phases; and a first signal output terminal of an n-th signal control unit provides the scanning signal to the pixel circuit of each pixel unit in an n-th row through a scanning line, a second signal output terminal of the n-th signal control unit provides the first light-emitting control signal to the pixel circuit of each pixel unit in the n-th row through a first light-emitting control line, and n is an integer greater than 0.

15. The display panel according to claim 14, wherein, in a case where the pixel unit comprises a second light-emitting control circuit, a second signal output terminal of an (n+1)-th signal control unit further provides a second light-emitting control signal to the pixel circuit of each pixel unit in the n-th row through a second light-emitting control line.

16. The display panel according to claim 14, wherein the signal control unit comprises an inverting circuit, and the inverting circuit is configured to invert a phase of the gate driving signal and output a signal which is obtained by inverting the phase of the gate driving signal through the second signal output terminal of the signal control unit.

17. A method for driving the pixel circuit according to claim 1, comprising a data writing phase and a light-emitting phase, wherein, in the data writing phase, the scanning signal is input to turn on the data writing circuit, so as to allow the data writing circuit to write the data signal into the driving circuit, and the first light-emitting control signal provided by the same gate driving circuit with the scanning signal is input to turn off the first light-emitting control circuit; and in the light-emitting phase, the first light-emitting control signal is input to turn on the first light-emitting control circuit and the driving circuit, the first light-emitting control circuit applies the first voltage to the first terminal of the driving circuit, and the driving current flows through the first terminal of the driving circuit and the second terminal of the driving circuit and further flows through the light-emitting component to drive the light-emitting component to emit light.

18. The method for driving the pixel circuit according to claim 17, wherein, in a case where the pixel circuit comprises a second light-emitting control circuit, in the light-emitting phase, a second light-emitting control signal is input to turn on the second light-emitting control circuit.

19. The method for driving the pixel circuit according to claim 17, wherein, in a case where the pixel circuit comprises a compensation circuit, in the data writing phase, the scanning signal is input to turn on the data writing circuit, the driving circuit, and the compensation circuit, and the compensation circuit stores the data signal and performs compensation on the driving circuit.

20. The method for driving the pixel circuit according to claim 19, wherein, in a case where the pixel circuit comprises a reset circuit, the method for driving the pixel circuit further comprises an initialization phase, in the initialization phase, the scanning signal is input to turn on the reset circuit and the compensation circuit, and a reset voltage is applied to the control terminal of the driving circuit and the light-emitting component.

* * * * *